US009469115B2

(12) United States Patent
Naito et al.

(10) Patent No.: US 9,469,115 B2
(45) Date of Patent: Oct. 18, 2016

(54) LIQUID CONTAINER, ADAPTER, AND LIQUID EJECTING APPARATUS

(71) Applicant: SEIKO EPSON CORPORATION, Tokyo (JP)

(72) Inventors: Naoki Naito, Nagano (JP); Keiichiro Yoshino, Nagano (JP); Ryoji Fujimori, Nagano (JP); Takeshi Iwamuro, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/679,247

(22) Filed: Apr. 6, 2015

(65) Prior Publication Data

US 2015/0290946 A1 Oct. 15, 2015

(30) Foreign Application Priority Data

Apr. 11, 2014 (JP) ..... 2014-081709

(51) Int. Cl.
*B41J 2/175* (2006.01)

(52) U.S. Cl.
CPC ..... *B41J 2/17503* (2013.01); *B41J 2/1752* (2013.01)

(58) Field of Classification Search
CPC ... B41J 2/175; B41J 2/17596; B41J 2/17526
See application file for complete search history.

(56) References Cited

U.S. PATENT DOCUMENTS 6,582,068 B2 * 6/2003 Ishizawa ..... B41J 2/175 347/85
2005/0104942 A1 5/2005 Katayama et al.

FOREIGN PATENT DOCUMENTS

JP 2005-138545 A 6/2005

* cited by examiner

*Primary Examiner* — Geoffrey Mruk
(74) *Attorney, Agent, or Firm* — Global IP Counselors, LLP

(57) ABSTRACT

A liquid container is configured to be detachably attached to a liquid container containing section in a liquid ejecting apparatus that includes the liquid container containing section, a supply flow path that supplies liquid from a liquid supply section that is provided in the liquid container containing section to a liquid ejecting section, and an opening and closing section that opens and closes the supply flow path. The liquid container includes an operation section configured to switch an opening and closing state of the opening and closing section by working together with an attaching and detaching operation with regard to the liquid container containing section.

15 Claims, 11 Drawing Sheets

LIQUID CONTAINER, ADAPTER, AND LIQUID EJECTING APPARATUS

CROSS-REFERENCE TO RELATED APPLICATIONS

This application claims priority to Japanese Patent Application No. 2014-081709 filed on Apr. 11, 2014. The entire disclosure of Japanese Patent Application No. 2014-081709 is hereby incorporated herein by reference.

BACKGROUND

1. Technical Field

The present invention relates to a liquid container and an adapter that are configured to be detachably attached to a liquid ejecting apparatus, and a liquid ejecting apparatus to which a liquid container and an adapter are detachably attached.

2. Related Art

In the prior art, there is a liquid ejecting apparatus which is provided with a liquid ejecting section which ejects liquid such as ink where an ink container which retains liquid is able to be attached and detached. JP-A-2005-138545 (PTL 1) discloses an example of this type of liquid ejecting apparatus. An ink jet recording apparatus (a liquid ejecting apparatus) in PTL 1 is provided with a mounting section where an ink cartridge (a liquid container) is mounted so as to be able to be attached and detached and an ink extraction pipe is provided in the mounting section. In addition, an ink supply chamber, where a sealing member is arranged in a joint portion where the ink extraction pipe is connected, is provided in the ink cartridge. When the ink cartridge is mounted in the mounting section, the sealing member is pressed and changes shape due to the ink extraction pipe, and the ink supply chamber and an inner section flow path of the ink extraction pipe are linked.

SUMMARY

In PTL 1, the ink supply chamber, where the sealing member is arranged in the joint section of the ink cartridge, is provided and this functions as a check valve. Accordingly, when the ink cartridge is removed, ink which is in an inner section of the ink cartridge does not leak due to the check valve being closed. However, a means for stopping outflow of ink from the ink extraction pipe is not provided in the ink jet recording apparatus. Accordingly, there is a concern that there will be leakage of ink inside the ink jet recording apparatus when the ink cartridge is removed.

Considering these points, the problem of the present invention is to propose a liquid container, an adapter, and a liquid ejecting apparatus which are appropriate in preventing leakage of liquid at a liquid flow path in the apparatus which is a liquid ejecting apparatus where a liquid container is able to be attached and detached.

In order to solve the problem described above, the present invention is a liquid container configured to be detachably attached to a liquid container containing section in a liquid ejecting apparatus that includes the liquid container containing section, a supply flow path that supplies liquid from a liquid supply section that is provided in the liquid container containing section to a liquid ejecting section, and an opening and closing section that opens and closes the supply flow path, the liquid container including an operation section configured to switch an opening and closing state of the opening and closing section by working together with an attaching and detaching operation with regard to the liquid container containing section.

In addition, in order to solve the problem described above, the present invention is an adapter configured to be detachably attached to a liquid container containing section in a liquid ejecting apparatus that includes the liquid container containing section, a supply flow path that supplies liquid from a liquid supply section in the liquid container containing section to a liquid ejecting section, and an opening and closing section that opens and closes the supply flow path, and configured to be attached to a liquid containing body that is contained in the liquid container containing section, the adapter including an operation section configured to switch an opening and closing state of the opening and closing section by working together with an attaching and detaching operation with regard to the liquid container containing section.

In addition, in order to solve the problem described above, a liquid ejecting apparatus according to the present invention includes a liquid container containing section, a supply flow path that supplies liquid from a liquid supply section that is provided in the liquid container containing section to a liquid ejecting section, and an opening and closing section that opens and closes the supply flow path, wherein an opening and closing state of the opening and closing section is switched by an operation section that is provided in a liquid container by working together with an attaching and detaching operation of the liquid container with regard to the liquid container containing section.

According to the present embodiment, when the liquid container (for example, the liquid container where the adapter is attached to the liquid containing body) is removed from the liquid container containing section, it is possible for the operation section to move to work together with this operation and for the opening and closing section to be closed. Accordingly, it is possible to reliably close the opening and closing section even when the liquid container is extracted in a state where the power of the liquid ejecting apparatus is turned off. As such, it is possible to prevent leakage of liquid from the supply flow path. In addition, it is possible to prevent connection faults since it is possible to reliably open the opening and closing section when the liquid container is mounted.

In the present invention, it is desirable that the operation section is movable in a mounting direction of the liquid container (or the adapter) with regard to the liquid container containing section. In addition, it is desirable that the opening and closing state of the opening and closing section be switched by the operation section that moves in the mounting direction of the liquid container with regard to the liquid container containing section. By doing this, it is possible for the operation section to have a simple configuration. Accordingly, it is advantageous in terms of reducing size and saving space.

In the present invention, it is desirable that the operation section abuts with one end of an intermediate member that is arranged between the opening and closing section and the operation section, and that the opening and closing section abuts with the other end of the intermediate member. In addition, it is desirable that the opening and closing section is abuttable with the other end of the intermediate member that is arranged between the opening and closing section and the operation section and one end of which is abuttable with the operation section. By doing this, it is possible to reduce the dimensions of the operation section. Accordingly, it is possible to reduce damage to the operation section in a case where shocks are applied such as when the liquid container is mounted or dropped.

In the present invention, it is desirable that the operation section have an abutting section that abuts with the one end of the intermediate member, and that an area of the abutting section be larger than an area of the one end of the intermediate member. By doing this, it is possible to maintain a state of abutting between the one end of the intermediate member and the abutting section even when there is positional deviation between the abutting section and the one end of the intermediate member due to an environmental change such as a change in temperature or humidity. Accordingly, it is possible to reliably open and close the opening and closing section.

In the present invention, it is desirable that the operation section includes a protrusion, that a circuit board that is configured to connect with a connection terminal in the liquid ejecting apparatus is provided in the operation section, and that the abutting section is arranged more to a tip end side than the circuit board in the mounting direction of the liquid container. By doing this, it is possible to prevent damage to the circuit board due to a part that protrudes even further than the circuit board such as when the liquid container is mounted or dropped. In addition, it is advantageous in terms of saving space and simplifying the configuration since it is not necessary to separately secure a part for attaching the circuit board.

In the present invention, it is desirable that the abutting section is provided below the circuit board in a vertical direction. By doing this, it is difficult for foreign matter, which is generated due to contact between the abutting section and the intermediate member, to fall onto the circuit board. Accordingly, it is possible to prevent contact faults between the circuit board and the connection terminal due to foreign matter.

According to the present invention, when a liquid container (for example, a liquid container where an adapter is attached to a liquid containing body) is removed from a liquid container containing section, it is possible for an operation section to move to work together with this operation and for an opening and closing section to be closed. Accordingly, it is possible to prevent leakage of liquid from a supply flow path. In addition, it is possible to prevent connection faults since it is possible to reliably open the opening and closing section when the liquid container is mounted.

BRIEF DESCRIPTION OF THE DRAWINGS

Referring now to the attached drawings which form a part of this original disclosure.

DETAILED DESCRIPTION OF EMBODIMENTS

An embodiment of a liquid ejecting apparatus and a liquid container which is attached to and detached from a liquid container containing section in the liquid ejecting apparatus where the present invention is applied will be described below with reference to the drawings. In the following embodiment, the present invention is applied to an ink container which is attached to and detached from an ink container containing section in the ink jet printer, but it is possible to apply the present invention to a liquid container in a liquid ejecting apparatus which ejects liquids other than ink.

(Overall Configuration)

Figure 1A:
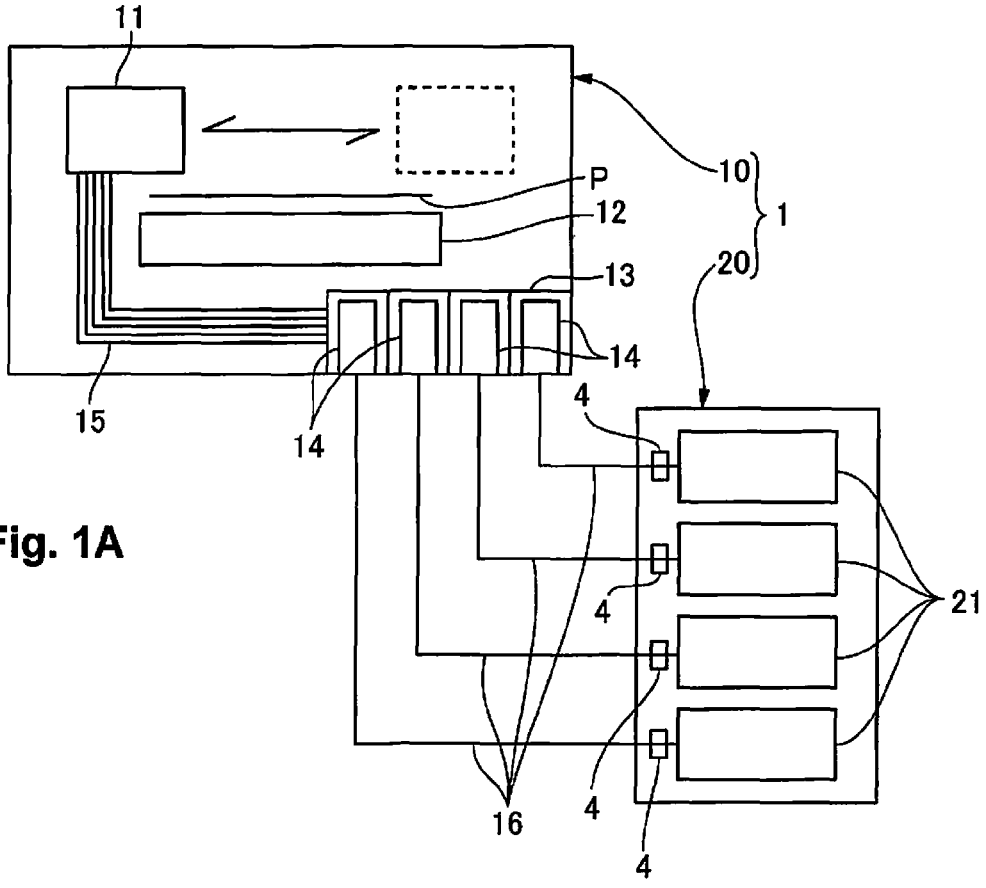
FIGS. 1A and 1B are explanatory diagrams schematically illustrating main sections of an ink jet printer where the present invention is applied.
Figure 1B:
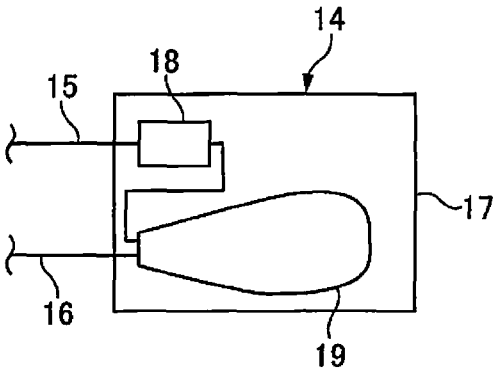

FIGS. 1A and 1B are explanatory diagrams schematically illustrating main sections of a printer where the present invention is applied, FIG. 1A illustrates the overall configuration and FIG. 1B illustrates the configuration of an intermediate tank. A printer 1 (a liquid ejecting apparatus) is an ink jet printer and is provided with a printer body section 10 and an ink containing unit 20. The printer body section 10 performs printing on a printing medium P using ink which is an example of a liquid. The ink containing unit 20 retains ink which is supplied to the printer body section 10.

An ink jet head 11 (a liquid ejecting section), a platen unit 12, a medium transport mechanism (which is omitted from the drawings), a head moving mechanism (which is omitted from the drawings), and the like are provided at an inner section of the printer body section 10. The printing medium P is transported along a platen surface by the medium transport mechanism which is provided with a paper feeding roller, a paper feeding motor, and the like. The ink jet head 11 is moved back and forth by the head moving mechanism in a direction which cuts across the platen surface. The head moving mechanism is provided with a carriage which is mounted with the ink jet head 11, a carriage guide shaft which extends in a direction which cuts across the platen surface, a carriage moving mechanism which moves the carriage back and forth along the carriage guide shaft, a carriage motor, and the like. When the printing medium P passes over the platen surface, printing is performed using the ink jet head 11.

In addition, the printer body section 10 is provided with a cartridge mounting section 13. One each of intermediate tanks 14 which contain ink of each color of cyan ink C, magenta ink M, yellow ink Y, and black ink Bk are mounted in the cartridge mounting section 13. The ink jet head 11 and the intermediate tanks 14 are connected by supply tubes 15 which are flexible. On the other hand, the ink containing unit 20 is provided with the same number of main tanks 21 as the number of the intermediate tanks 14 (four in the present embodiment). The four main tanks 21 are supported by a support frame of the ink containing unit 20. The intermediate tanks 14 and the main tanks 21 are connected by supply tubes 16 which are flexible. Check valves 4 (opening and closing sections) are provided in the supply tubes 16 at sections which connects with the main tank 21. As will be described later, opening and closing of the check valves 4 is switched according to the attaching and detaching states of the ink containers 23 in the main tanks 21. Here, the number of the intermediate tanks 14 and the main tanks 21 may be a number other than four, and the types of ink which are contained may be different to the four inks described above. In addition, pressurizing sections (which are omitted from the drawings) are provided in each of the main tanks 21 inside the ink containing unit 20. The main tanks 21 are pressurized using pressurized air which is fed from the pressurizing sections.

As shown in FIG. 1B, the intermediate tanks 14 are provided with cartridge type casings 17, and filters 18 and ink containers 19 which are arranged at an inner section of the casings 17. The ink containers 19 are tube containers which are flexible and, for example, blow bottles which are manufactured from resin are used. When the intermediate tanks 14 are mounted in cartridge mounting section 13, ink supply needles are inserted into connection ports which are provided in the casings 17. Due to this, the ink containers 19 and the supply tubes 15 are connected via filters 18, and the ink containers 19 and the supply tubes 16 are connected. Accordingly, it is possible for ink which is retained in the main tanks 21 to be supplied to the intermediate tanks 14, temporarily retained, and supplied from the intermediate tanks 14 to the ink jet head 11.

(Main Tank)

Figure 2:
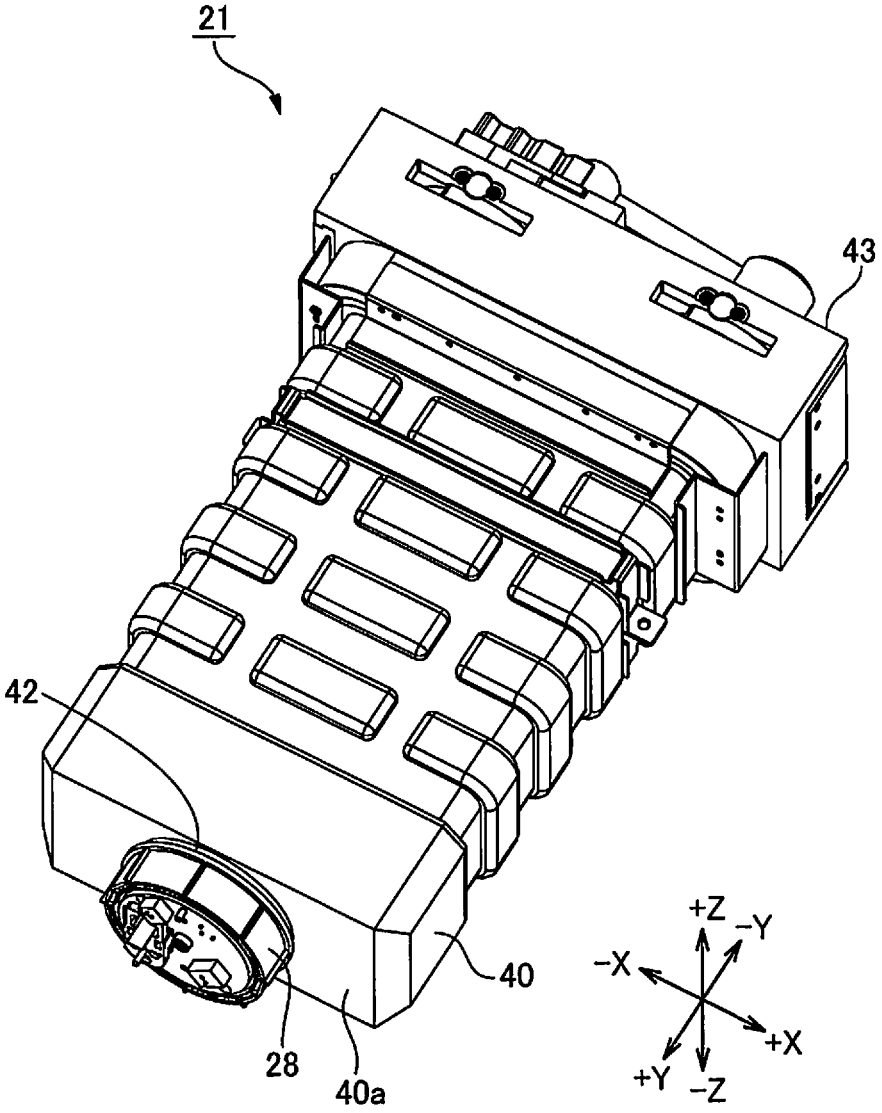
FIG. 2 is a perspective diagram of the outer appearance of a main tank.
Figure 3:
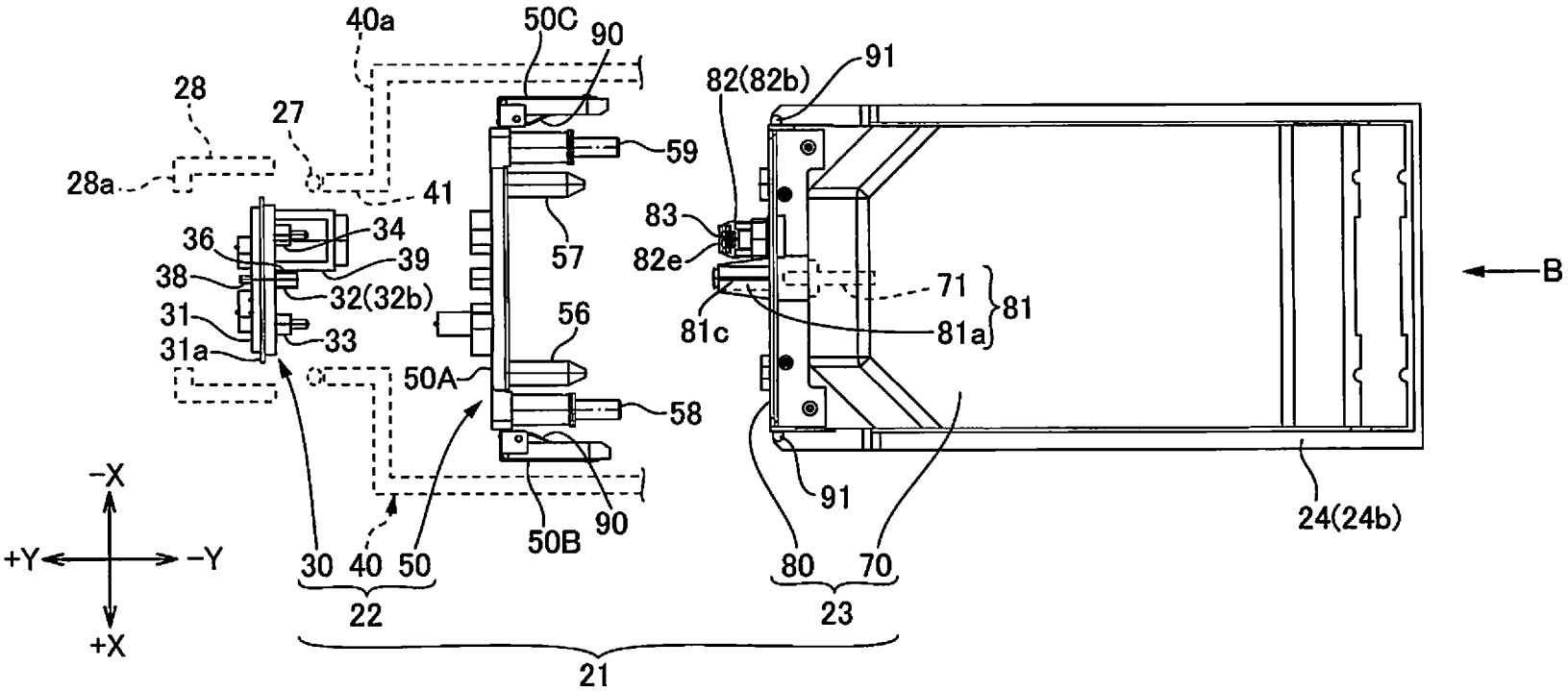
FIG. 3 is an exploded planar diagram of a main tank.
Figure 4:
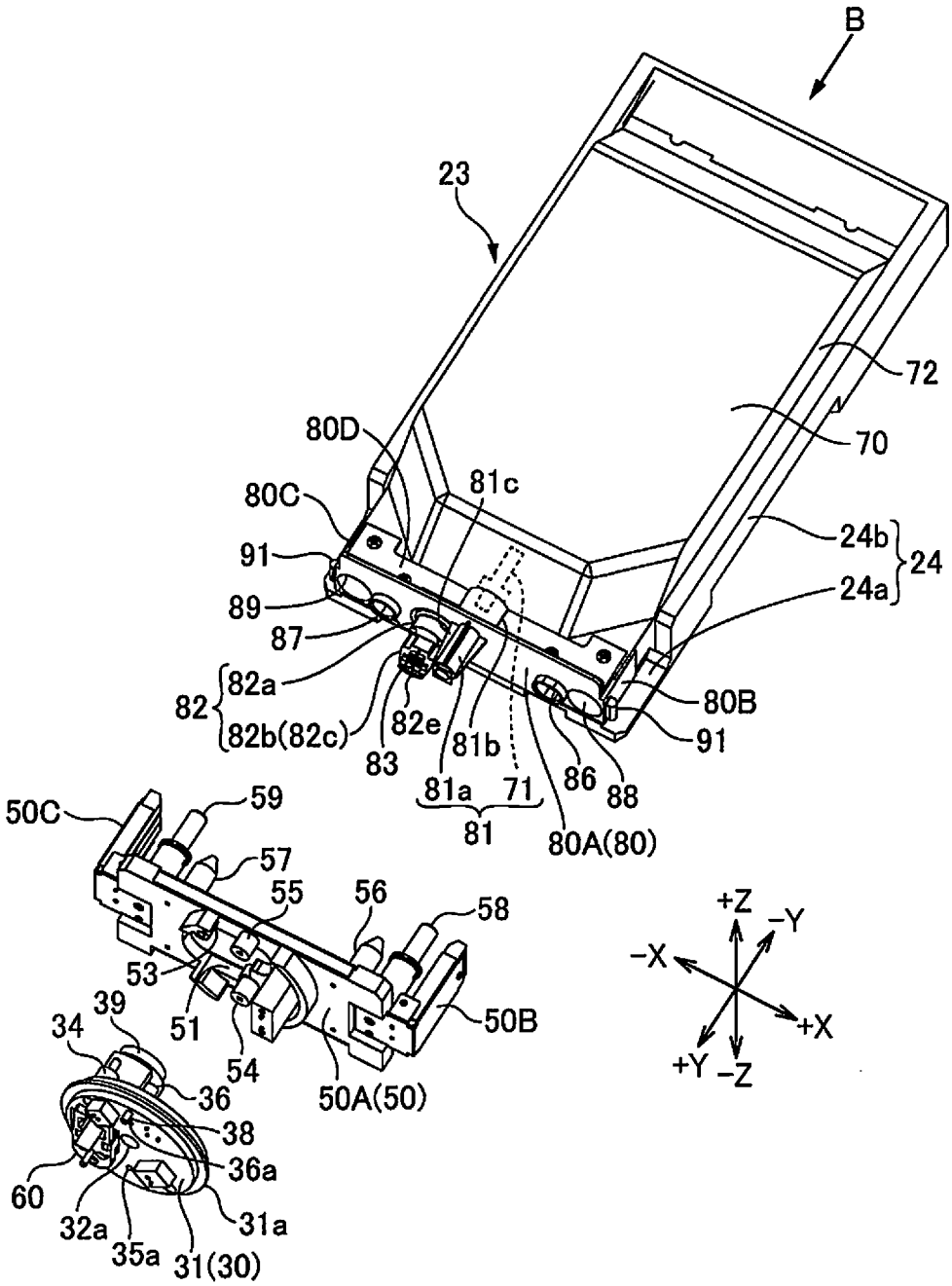
FIG. 4 is an exploded perspective diagram of a main tank.

FIG. 2 is a perspective diagram of the outer appearance of the main tank 21, and FIG. 3 is an exploded planar diagram of the main tank 21. In addition, FIG. 4 is an exploded perspective diagram of the main tank 21 and illustrates a state where a blow tank is omitted. The main tank 21 is provided with an ink container containing section 22 (a liquid container containing section) which is a sealed container, an ink container 23 (a liquid container) which is mounted in an inner section of the ink container containing section 22 so as to be able to be attached and detached, and a tray 24 onto which the ink container 23 is loaded. The ink container containing section 22 is provided with a cover 30 with a circular shape, a blow tank 40, and a mounting member 50. The mounting member 50 is arranged in an inner section of the blow tank 40 on the rear side of the cover 30. In the present description below, a container width direction X, a container forward and backward direction Y, and a container up and down direction Z are three directions which are orthogonal to each other. In addition, one side in the container width direction X is a +X direction and the other side in the container width direction X is a −X direction, one side in the container forward and backward direction Y is a +Y direction and the other side in the container forward and backward direction Y is a −Y direction, and one side in the container up and down direction Z is a +Z direction and the other side in the container up and down direction Z is a −Z direction.

(Structure for Opening and Closing Ink Container Containing Section)

The blow tank 40 is a container which is manufactured from resin with a substantially rectangular shape which is long in the container forward and backward direction Y. A circular opening 41 (refer to FIG. 3), which passes through a container front surface section 40*a* which is positioned at an end section on the +Y direction side, is formed in the blow tank 40. A cylindrical section 42 which protrudes to the +Y direction side is formed at an opening edge of the circular opening 41. The cover 30 is mounted at a tip end of the cylindrical section 42 and covers and blocks off the circular opening 41 in an air-tight state. The cover 30 is provided with a cover body section 31 with a substantially circular plate shape, and a flange section 31*a* overhangs with an annular shape from the outer circumferential end surface of the cover body section 31. An O-ring 27 (refer to FIG. 3) is arranged between the flange section 31*a* and the tip end surface of the cylindrical section 42. In addition, an outer side ring 28 (refer to FIG. 2 and FIG. 3) is mounted at the outer circumferential side of the cylindrical section 42 and the cover 30. The outer circumferential surface of the cylindrical section 42 and the inner circumferential surface of the outer side ring 28 oppose each other in the radial direction, a male screw section is formed in one out of the outer circumferential surface of the cylindrical section 42 and the inner circumferential surface of the outer side ring 28, and a female screw section is formed in the other out of the outer circumferential surface of the cylindrical section 42 and the inner circumferential surface of the outer side ring 28. The outer side ring 28 is mounted such that the screw sections mesh with each other. An annular section 28*a* which overhangs on the inner circumferential side is formed on an end section of the outer side ring 28 on the +Y direction side. When the outer side ring 28 is fastened, the annular section 28*a* presses on the flange section 31*a* from the +Y direction side. Due to this, a gap between the flange 31*a* and the cylindrical section 42 is sealed by the O-ring 27.

On the other hand, a rear side opening (which is omitted from the drawings) which is an opening in the −Y direction is formed in the blow tank 40 at an end section which is at the opposite side to the circular opening 41, and an opening and closing door 43 which opens and closes the rear side opening is attached. The opening and closing door 43 opens and closes by swinging with one end side in the container width direction X as the center. The ink container 23 and the tray 24 move in and out from the rear side opening to the inside of the blow tank 40 due to the opening and closing door 43 being opened. When the opening and closing door 43 is closed, the rear side opening is blocked off in the air-tight state.

(Ink Supply Section)

Figure 5B:
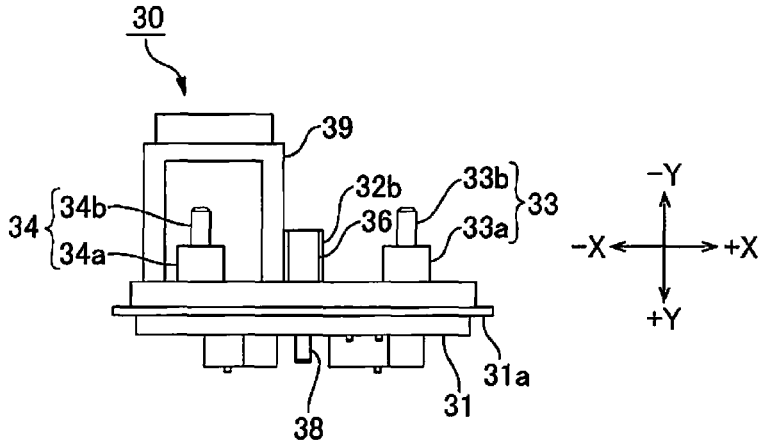
FIGS. 5B and 5C are side surface diagrams of a cover.
Figure 5A:
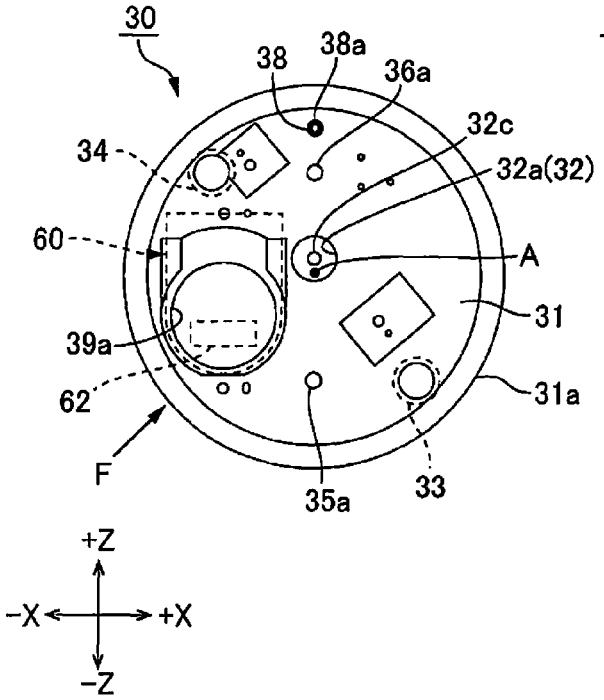
FIG. 5A is a front surface diagram of a cover.
Figure 5C:
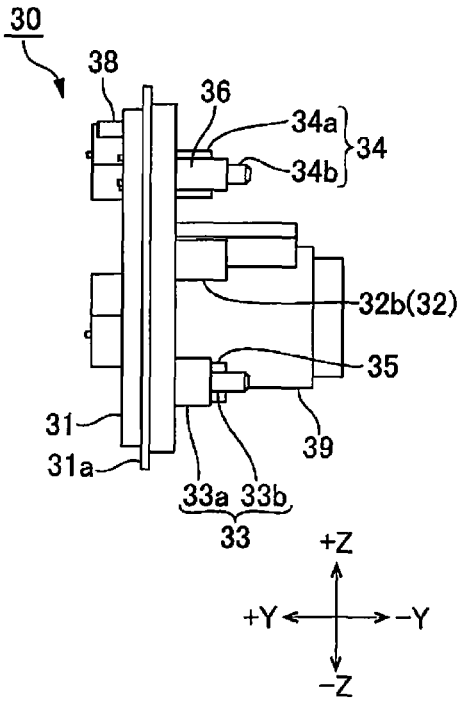
Figure 6:
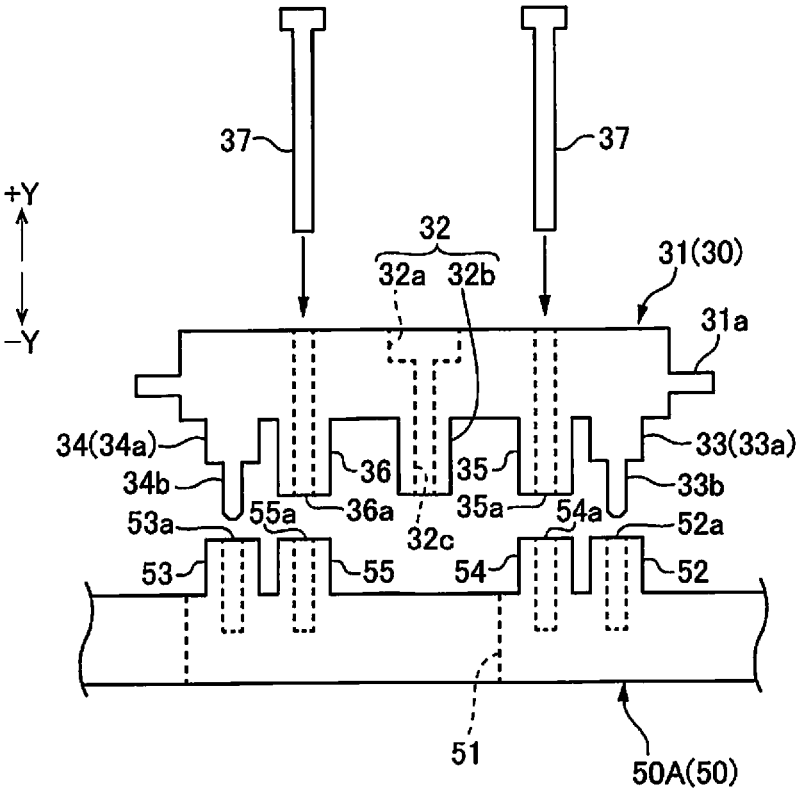
FIG. 6 is an explanatory diagram schematically illustrating a structure for fixing a cover and a mounting member.

FIG. 5A is a front surface diagram of the cover 30, and FIG. 5B, and FIG. 5C are side surface diagrams of the cover 30, FIG. 5A is a front surface diagram viewed from the +Y direction side, FIG. 5B is a side surface diagram viewed from the +Z direction side, and FIG. 5C is a side surface diagram viewed from the +X direction side. In addition, FIG. 6 is an explanatory diagram schematically illustrating a structure for fixing the cover 30 and the mounting member 50 (a diagram viewed from the direction of an arrow F in FIG. 5A) and illustrates a state where the mounting member 50 and the cover 30 are separated in the container forward and backward direction Y.

The cover 30 is mounted in a state of being able to rotate with regard to the circular opening 41 of the blow tank 40 with the central axis line of the cylindrical section 42 as the center. An ink supply section 32 (a liquid supply section) is provided in the cover 30 at a position which is slightly deviated from a center of rotation A (refer to FIG. 5A). The ink supply section 32 is provided with a connection port 32*a* which is an opening in a surface of the cover body section 31 on the +Y direction side and a protruding section 32*b* which protrudes in the −Y direction from a position on the rear side of the connection port 32*a* in the cover body section 31. The supply tube 16, which configures an ink flow path with the intermediate tank 14, is connected with the connection port 32*a*. An ink supply needle (which is omitted from the drawings) is provided at the tip end of the protruding section 32*b*, and the ink flow path 32*c*, which links the connection port 32*a* and the ink supply needle, is formed at an inner section of the protruding section 32*b*.

On the other hand, the mounting member 50 is provided with a mounting member body section 50A with a substantially rectangular shape which is long in the container width direction X, and end plate sections 50B and 50C which are provided at either end of the mounting member body section 50A in the container width direction X. A through hole section 51 is formed in the mounting member body section 50A in a region which overlaps with the ink supply section 32 in the container forward and backward direction Y. The through hole section 51 passes through the mounting member body section 50A in the container forward and backward direction Y. In the ink container containing section 22, the mounting member 50 is arranged inside the blow tank 40 on the circular opening 41 side, and the cover 30 is arranged outside the blow tank 40 on the circular opening 41 side. That is, the mounting member 50 and the cover 30 are arranged so as to interpose the cylindrical section 42 of the blow tank 40 and are fixed using the structure for fixing which will be described below. At this time, the ink supply needle of the ink supply section 32 is flush with the through hole section 51 and opposes the ink container 23 which is mounted on the rear surface side of the mounting member body section 50A.

(Structure for Fixing Cover and Mounting Member)

As shown in FIG. 5A, positional alignment protrusions 33 and 34 which protrude to the −Y direction side are formed in the cover body section 31 at two locations which are point symmetrical with the center of rotation A as a reference. That is, the positional alignment protrusions 33 and 34 are formed at positions which are closer to the outer edge of the cover 30 than the center of rotation A. The base end section of the positional alignment protrusion 33 is a large diameter section 33*a* with a circular column shape, and the tip end section of the positional alignment protrusion 33 is a small diameter section 33*b* with a circular column shape which has a smaller diameter than the large diameter section 33*a*. A taper section, where the diameter is reduced in accompaniment with heading toward the tip end side, is formed at the tip end of the small diameter section 33*b*. The positional alignment protrusion 34 has the same shape as the positional alignment protrusion 33 and is provided with a large diameter section 34*a* and a small diameter section 34*b*. On the other hand, circular column protruding sections 52 and 53 (refer to FIG. 4 and FIG. 6) are formed in the mounting member body section 50A at positions which overlap with the positional alignment protrusions 33 and 34 in the container forward and backward direction Y. The circular column protruding sections 52 and 53 protrude from the mounting member body section 50A in the +Y direction. Positional alignment holes 52*a* and 53*a* are openings in end surfaces of the circular column protruding sections 52 and 53 on the +Y direction side. The positional alignment holes 52*a* and 53*a* are concave sections which do not pass through the mounting member body section 50A, and the depth of the positional alignment holes 52*a* and 53*a* is deeper than the length of the small diameter sections 33*b* and 34*b*.

In addition, boss sections 35 and 36 are formed in the cover body section 31 at two locations, which are different to the positions of the positional alignment protrusions 33 and 34 in the circumferential direction, at positions which are away from the center of rotation A. The boss sections 35 and 36 are arranged at two locations which are point symmetrical with the center of rotation A as a reference and protrude from the cover body section 31 in the −Y direction. Fixing holes 35*a* and 36*a*, which pass through the cover body section 31 and the boss sections 35 and 36 in the container forward and backward direction Y, are formed in the cover 30. The fixing holes 35*a* and 36*a* are arranged at positions which are closer to the center of rotation A of the cover 30 than the positional alignment protrusions 33 and 34. On the other hand, boss sections 54 and 55 are formed in the mounting member body section 50A at positions which overlap with the fixing holes 35*a* and 36*a* in the container forward and backward direction Y. Fixing holes 54*a* and 55*a* are openings in the end surfaces of the boss sections 54 and 55 on the +Y direction side. The fixing holes 54*a* and 55*a* are concave sections which do not pass through the mounting member body section 50A.

As described above, the cover 30 and the mounting member 50 are fixed with screws so as to interpose the cylindrical section 42, which is provided at the opening edge of the circular opening 41 in the blow tank 40, from both sides in the container forward and backward direction Y. As shown in FIG. 6, first, the small diameter sections 33*b* and 34*b* of the positional alignment protrusions 33 and 34 which protrude from the cover 30 and the positional alignment holes 52*a* and 53*a* of the circular column protruding sections 52 and 53 which protrude from the mounting member 50 are opposed in the container forward and backward direction Y during fixing. Then, the mounting member 50 and the cover 30 approach each other in the container forward and backward direction Y, and the small diameter section 33*b* is inserted into the positional alignment hole 52*a* and the small diameter section 34*b* is inserted into the positional alignment hole 53*a*. At this time, inserting of the small diameter sections 33*b* and 34*b* is guided by the taper section which is at the tip end. Then, the mounting member 50 is positionally aligned with regard to the cover 30 in the container forward and backward direction Y due to the tip end surfaces of the boss sections 54 and 55 abutting with the tip end surfaces of the boss sections 35 and 36.

The mounting member 50 and the cover 30 are positionally aligned by the positional alignment protrusions 33 and 34 engaging with the positional alignment holes 52*a* and 53*a*. Out of the engaging sections at the two locations, one is an engaging section which sets a reference position and the other is an engaging section for stopping rotation where a relative rotation position where the reference position is the center is set. When the mounting member 50 is positionally aligned with regard to the cover 30, the fixing holes 35*a* and 36*a* on the cover 30 side and the fixed holes 54*a* and 55*a* at the mounting member body section 50A side overlap in the container forward and backward direction Y. In this state, fixing screws 37 are attached to each of the fixing holes 35*a* and 36*a* from the outer side of the tank (the +Y direction side), and the tip ends of the fixing screws 37 are screwed into the fixed holes 54*a* and 55*a* until locked. Due to this, the mounting member 50 is fixed by screws with regard to the cover 30.

(Pressurizing Hole)

As shown in FIG. 2 to FIGS. 5A to 5C, a pressurizing tube connecting section 38 which protrudes in the +Y direction is formed in the cover 30 at a position which is closer to the outer edge of the cover 30 than the center of rotation A, in more detail, on an outer side of the fixing hole 35*a* in the radial direction. A pressurizing hole 38*a* (refer to FIGS. 5A to 5C) is an opening in the tip end of the pressurizing tube connecting section 38. The pressurizing hole 38*a* passes through the pressurizing tube connecting section 38 and the cover body section 31 in the container forward and backward direction Y. The pressurizing tube, which extends from the pressurizing section which is arranged in the vicinity of the cover 30, is connected with the pressurizing tube connecting section 38. Pressurized air (pressurized fluid) from the pressurizing tube flows into the pressurizing hole 38*a*. When the circular opening 41 and the rear side opening are sealed, the inner section of the ink container containing section 22 becomes a sealed space. Pressurized air is fed into the sealed space from the pressurizing hole 38*a* and the ink container containing section 22 is pressurized. As described above, since the fixed holes 54*a* and 55*a* and the positional alignment holes 52*a* and 53*a* which are used to fix the cover 30 and the mounting member 50 do not pass through the mounting member 50, the ink container containing section 22 becomes a section where only the two locations of the pressurizing hole 38*a* and the ink supply section 32 are linked with the outside.

(Terminal Arrangement Section)

As shown in FIGS. 5A to 5C, a terminal arrangement section 39 is provided in the cover 30 between the positional alignment protrusion 33 and the fixing hole 36*a*. The terminal arrangement section 39 is arranged at a position which is closer to the center of rotation A of the cover 30 than the pressurizing hole 38*a*. In addition, the ink supply section 32 is formed at a position which is even closer to the center of rotation A than the terminal arrangement section 39. The diameter (the inner diameter) of the ink flow path 32*c* which is formed in the ink supply section 32 is larger than the diameter (the inner diameter) of the pressurizing hole 38*a*. The terminal arrangement section 39 protrudes from the cover body section 31 in the −Y direction. When the cover 30 and the mounting member 50 are fixed, the terminal arrangement section 39 is arranged in the through hole section 51 of the mounting member body section 50A and protrudes into the space in which the ink container 23 is arranged. The through hole section 39*a* which passes through in the container forward and backward direction Y is formed in the terminal arrangement section 39. The through hole section 39*a* is an open hole, one end of the through hole section 39*a* is an opening in the tip end surface on the −Y direction side of the terminal arrangement section 39, and the other end of the through hole section 39*a* is an opening in the surface on the +Y direction side of the cover body section 31. A connector unit 60 is mounted in the through hole section 39*a*. In addition, a board holding section 82 (refer to FIG. 3 and FIG. 4) which is provided at the front end of the ink container 23 is inserted into the through hole section 39*a* in the +Y direction. As will be described later, a circuit board 83 (refer to FIG. 3 and FIG. 4) is provided in the board holding section 82 and a connection terminal 62 (refer to FIGS. 5A to 5C and FIGS. 9A to 9C) which is connected to the circuit board 83 is provided in the connector unit 60. Since the connection terminal 62 is arranged in the through hole section 39*a* of the terminal arrangement section 39, the connection terminal 62 is closer to the center of rotation A of the cover 30 than the pressurizing hole 38*a* and is separated from the center of rotation A more than the ink supply section 32.

(Ink Container)

Figure 7:
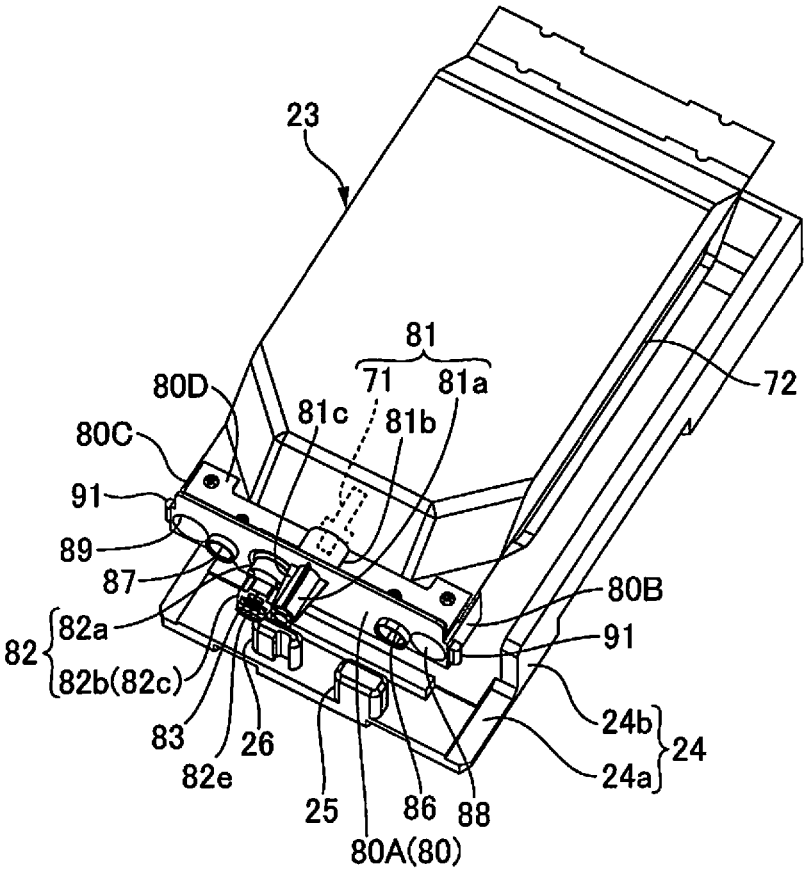
FIG. 7 is a perspective diagram illustrating a state where an ink container is lifted up from a tray.
Figure 8A:
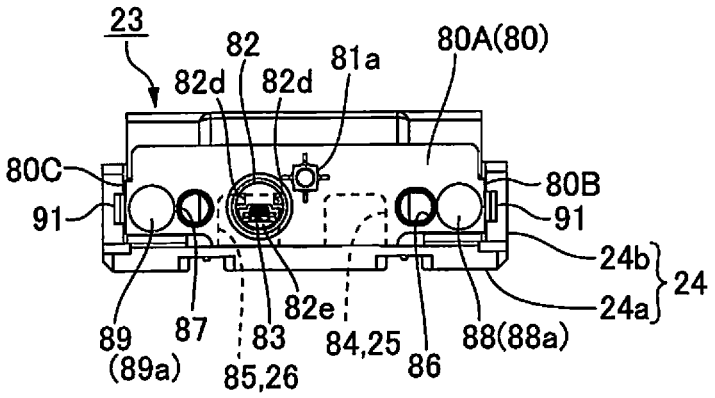
FIGS. 8A and 8B are front surface diagrams of an ink container and a tray.
Figure 8B:
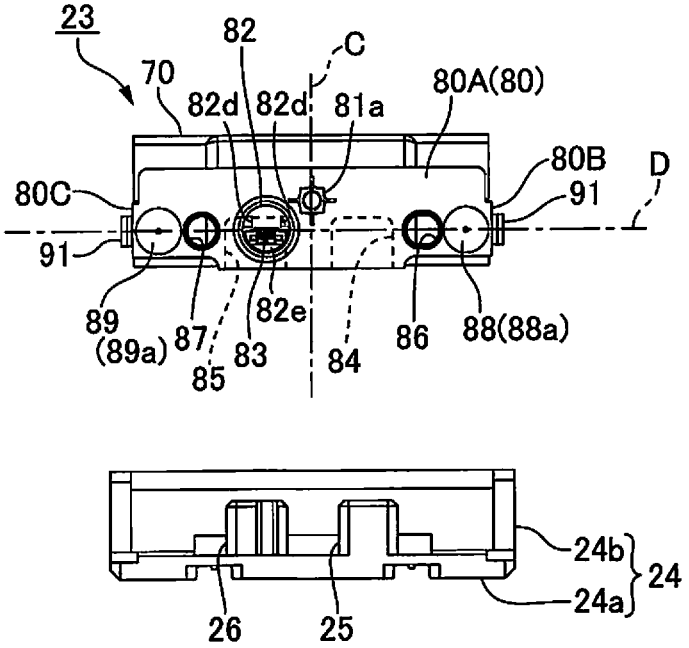

FIG. 7 is a perspective diagram illustrating a state where the ink container 23 is lifted up from a tray 24. In addition, FIGS. 8A and 8B are front surface diagrams of the ink container 23 and the tray 24. FIG. 8A illustrates a state where the ink container 23 is loaded on the tray 24 and FIG. 8B illustrates a state where the ink container 23 is lifted up from the tray 24. The ink container 23 is provided with an ink pack 70 (a liquid containing body) which is long in the container forward and backward direction Y and an adapter 80 which is attached to one end of the ink pack 70 in the longitudinal direction.

(Ink Pack)

The ink pack 70 is a liquid containing bag which is flexible and encloses ink in an inner section. The planar shape of the ink pack 70 is substantially rectangular and has a size which fits into the tray 24. A linking section 71 (refer to FIG. 7), which links the inside and the outside of the ink pack 70, is formed at an end section of the ink pack 70 on the +Y direction side. The ink pack 70 is in a sealed state except for the linking section 71. The linking section 71 is configured by attaching a component with a pipe shape to an edge of a bag body which is flexible. Gusset sections 72 are formed at side surfaces of the ink pack 70 on the +X direction side and the −X direction side. The gusset sections 72 extend in the container up and down direction Z when the full amount of ink in the ink pack 70 is large, and the capacity of the ink pack 70 is large. When the amount of ink is reduced due to ink being fed from the ink pack 70, the ink pack 70 is thin due to the gusset sections 72 being folded, and the capacity of the ink pack 70 is small.

(Adapter)

The adapter 80 is provided with a front plate section 80A which is long in the container width direction X, end plate sections 80B and 80C which are provided on either end of the front plate section 80A in the container width direction X, and an ink pack attachment section 80D which is provided on the rear surface side (on the −Y direction side) of the front plate section 80A. The ink pack attachment section 80D is fixed so as to interpose an end edge on the +Y direction side of the ink pack 70. The end plate sections 80B and 80C extend from both ends of the front plate section 80A in the −Y direction.

(Ink Leading Section)

The front plate section 80A is provided with an adapter front end surface with a substantially rectangular shape which faces the +Y direction. A protruding section 81*a* which protrudes in the +Y direction is formed at the center of the front plate section 80A in the container width direction X. In addition, a raised section 81*b*, which is formed on an upper surface (a surface in the +Z direction) of the ink pack attachment section 80D, extends from the rear side (the −Y direction side) of the protruding section 81*a* in the container forward and backward direction Y. An ink flow path, which passes through the protruding section 81*a* and the raised section 81*b* in the container forward and backward direction Y, is provided in the adapter 80, and one end of the ink flow path is an opening in the tip end surface of the protruding section 81*a*. The linking section 71 of the ink pack 70 is connected with the other end of the ink flow path. An ink leading section 81 (a liquid leading section) which leads ink from the ink pack 70 is configured using the protruding section 81*a*, the raised section 81*b*, and the linking section 71. The protruding section 81*a* is substantially a cylindrical shape and four ribs 81*c* which extend in the container forward and backward direction Y are formed on the outer circumference surface of the protruding section 81*a* at intervals with equal angles in the circumference direction. The protruding dimensions of each of the ribs 81*c* from the outer circumference surface of the protruding section 81*a* in accompaniment with heading toward the −Y direction increases and each of the ribs 81*c* are connected with the front plate section 80A.

When the ink container 23 is mounted in the ink container containing section 22, the ink leading section 81 is connected with the ink supply section 32 of the cover 30.

Accordingly, ink which is fed from the ink leading section 81 is supplied to the intermediate tank 14 through the ink supply section 32 and the supply tube 16. At this time, when the ink container containing section 22 is pressurized, feeding of ink into the inner section is promoted by the ink pack 70 being flattened due to air pressure.

(Structure for Fitting of Ink Container and Tray)

Moving the ink container 23 in and out of the ink container containing section 22 is performed in a state where the ink container 23 is loaded on the tray 24. The ink container 23 is arranged so that the adapter 80 is loaded on the end edge of the tray 24 on the +Y direction side. The ink container 23 and the tray 24 are inserted from the rear side opening in the ink container containing section 22 in a mounting direction B (the +Y direction in the present embodiment) in the ink container containing section 22 with the side where the adapter 80 is arranged as the front.

As shown in FIG. 7 and FIGS. 8A and 8B, the tray 24 where the ink container 23 is loaded is provided with a bottom plate section 24*a* with a rectangular shape which is long in the container forward and backward direction Y and a side wall section 24*b* which protrudes in the +Z direction along the end edges in three directions of the +X direction side, the −Y direction side, and the −X direction side of the bottom plate section 24*a*. A first fitting section 25 and a second fitting section 26 are provided in the tray 24 at an end edge of the bottom plate section 24*a* on the +Y direction side. The first fitting section 25 and the second fitting section 26 are protruding sections which protrude from the bottom plate section 24*a* in the +Z direction and are arranged so as to be separated in the container width direction X.

As shown in FIGS. 8A and 8B, when the adapter 80 is arranged at the front end of the tray 24, a first fitted section 84 is formed in the front plate section 80A of the adapter 80 at a position which overlaps with the first fitting section 25 in the container up and down direction Z, and a second fitted section 85 is formed in the front plate section 80A of the adapter 80 at a position which overlaps with the second fitting section 26 in the container up and down direction Z. The first fitted section 84 and the second fitted section 85 are convex sections which are both openings in the −Z direction. When the ink container 23 is loaded on the tray 24, the first fitting section 25 and the first fitted section 84 fit together in the container up and down direction Z, and the second fitting section 26 and the second fitted section 85 fit together in the container up and down direction Z. Due to this, the ink container 23 is positionally aligned with regard to the tray 24 in the container width direction X and the container forward and backward direction Y.

(Board Holding Section and Connector Unit)

As shown in FIG. 3, FIG. 4, FIG. 7, and the like, the board holding section 82 (an operation section), which is a protrusion which protrudes in the +Y direction, is formed in the front plate section 80A on the −X direction side of the protruding section 81*a*. The board holding section 82 is provided with a base end section 82*a* with a substantially circular column shape and a board attachment section 82*b* which protrudes even further from the tip end surface of the base end section 82*a* in the +Y direction. An O-ring (which is omitted from the drawings) is mounted on the outer circumference at the base of the base end section 82*a* of the board holding section 82. When the ink container 23 is mounted in the ink container containing section 22, the board holding section 82 is inserted into the through hole section 39*a* (refer to FIG. 5A) of the terminal arrangement section 39 which protrudes to the rear side of the cover 30. The board holding section 82 opposes the connector unit 60 (refer to FIG. 4 and FIGS. 5A to 5C), which is mounted in the through hole section 39*a* from the +Y direction side, in the container forward and backward direction Y.

An inclined surface 82*c* and an abutting surface 82*e* (an abutting section) are formed at the tip end of the board attachment section 82*b*. The inclined surface 82*c* is a surface where an XZ plane is inclined in a direction of inclination so as to move in the +Y direction in accompaniment with heading toward the −Z direction. The circuit board 83 is attached to the inclined surface 82*c*. A memory element which stores information such as the amount of ink which is inside the ink container 23 is provided in the circuit board 83. On the other hand, the abutting surface 82*e* is a surface which is perpendicular to the mounting direction B (the +Y direction) of the ink container 23 in the ink container containing section 22 and is provided on the −Z direction side of the inclined surface 82*c* at a position which protrudes even further than the inclined surface 82*c* in the +Y direction. The abutting surface 82*e* is positioned below the circuit board 83 in a vertical direction G when there is a posture (refer to FIGS. 10A and 10B) where the ink container 23 is mounted in the ink container containing section 22. In addition, the abutting surface 82*e* is arranged more to the tip end side than the circuit board 83 in the mounting direction B (+Y direction) of the ink container 23.

Figure 9A:
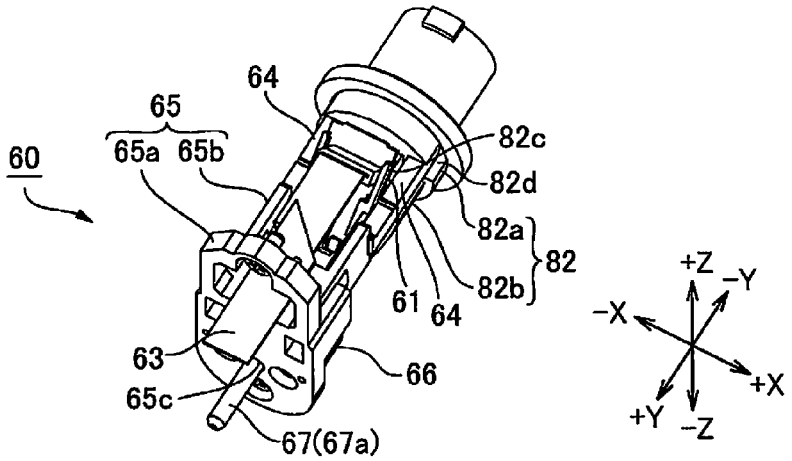
FIGS. 9A and 9C are perspective diagrams illustrating a connector unit and a board holding member.
Figure 9B:
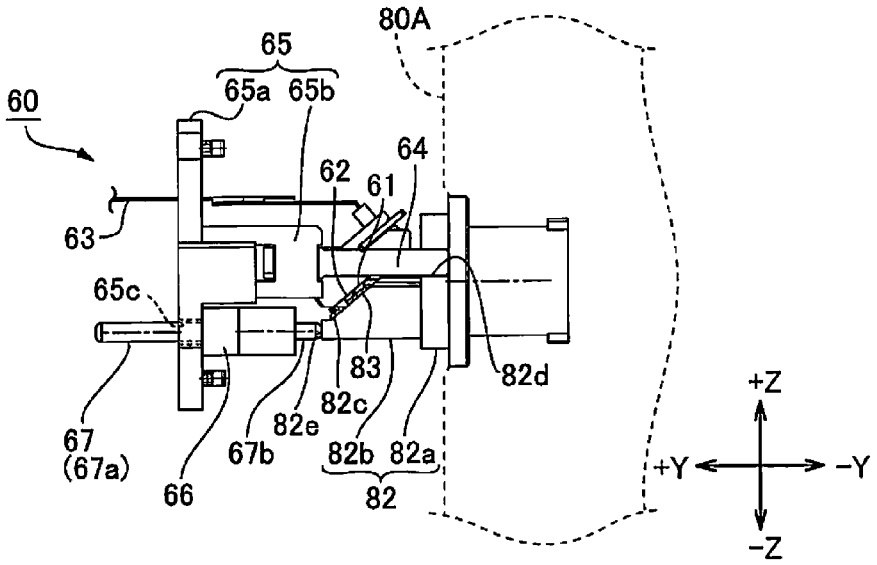
FIG. 9B is a side surface diagram illustrating a connector unit and a board holding member.
Figure 9C:
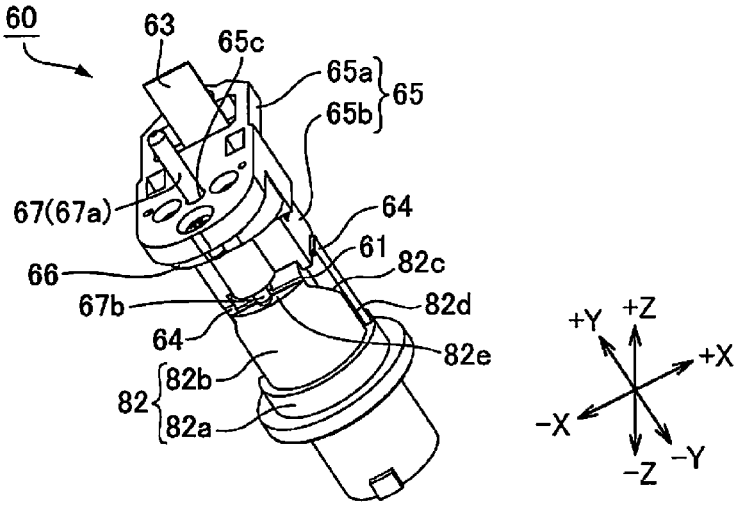

FIGS. 9A and 9C are perspective diagrams illustrating the connector unit 60 and the board holding member 82, FIG. 9B is a side surface diagram illustrating the connector unit 60 and the board holding member 82, FIGS. 9A and 9C are perspective diagrams viewed from the +Y direction side, and FIG. 9B is a side surface diagram viewed from the +X direction side. The board holding section 82 is formed by a separate component being mounted in a mounting hole which is formed in the front plate section 80A of the adapter 80. Here, the board holding section 82 may be integrally formed with the front plate section 80A.

The connector unit 60 is provided with a connector housing 65 which is fixed to the terminal arrangement section 39 of the cover 30 and an intermediate member 67 which is mounted in the connector housing 65 so as to be able to slide in the container forward and backward direction Y. The connector housing 65 is provided with a fixing section 65*a* with a plate shape which is arranged along the front surface of the cover 30 on the +Y direction side and a housing body section 65*b* which is inserted inside the through hole section 39*a* by protruding to the rear surface side (the −Y direction side) of the fixing section 65*a*. The connector housing 65 is fixed to the cover 30 due to the fixing section 65*a* being fixed by screws with regard to the cover 30. An inclined surface 61 which opposes the inclined surface 82*c* of the board holding section 82 is provided in the housing body section 65*b*. The inclined surface 61 is a surface which is parallel to the inclined surface 82*c* and the connection terminal 62 is arranged on the inclined surface 61. A wiring 63 which conducts with the connection terminal 62 is drawn around to the rear surface side of the inclined surface 61. The wiring 63 is drawn out to the front surface side of the cover 30 by passing through a hole which is formed in the fixing section 65*a* and is drawn around to the printer body section 10 side along with the supply tube 16 which is for supplying of ink.

A holding member 66 is arranged at a position on the −Z direction side with regard to the housing body section 65*b* and on the −Y direction side with regard to the fixing section 65*a*. The holding member 66 is fixed by screws to the fixing section 65*a*. A through hole (which is omitted from the drawings), which passes through in the container forward and backward direction Y, is formed in the holding member 66. In addition, a through hole 65*c* is formed in the fixing section 65*a* at a position which overlaps with the through holes in the holding member 66 and the intermediate member 67 is inserted into the through hole 65*c*. The intermediate member 67 is a member with a linear shape and is inserted into the holding member 66 and the fixing section 65*a* in a state so as to be able to move in the container forward and backward direction Y. In addition, the intermediate member 67 is pushed in the −Y direction by a coil spring which is built into the through hole in the holding member 66. An end section of the intermediate member 67 in the +Y direction is a first protruding section 67*a* which protrudes from the through hole 65*c* of the fixing section 65*a* to the front surface side (the +Y direction side) of the cover 30. On the other hand, an end section of the intermediate member 67 in the −Y direction is a second protruding section 67*b* which protrudes from the holding member 66 in the −Y direction. As will be described later, the intermediate member 67 is arranged between the check valve 4 (refer to FIGS. 1A and 1B and FIGS. 11A and 11B) which is arranged on the front surface side (on the +Y direction side) of the cover 30 and the board holding section 82 of the ink container 23.

While the ink container 23 is mounted in the ink container containing section 22, the board holding section 82 is inserted into the through hole section 39*a* of the cover 30 in accompaniment with the ink container 23 moving in the mounting direction B. At this time, the intermediate member 67 moves in the mounting direction B (in the +Y direction) due to being pressurized by the abutting surface 82*e* of the board holding section 82. The connection terminal 62, which is arranged at the inclined surface 61 of the connector unit 60, comes into contact with the circuit board 83 which is arranged on the inclined surface 82*c* of the adapter 80 as shown in FIGS. 9A to 9C when the ink container 23 is mounting in the ink container containing section 22 is completed. In addition, at this time, the intermediate section 67 has the largest protruding dimensions to the +Y direction side of the first protruding section 67*a*. The intermediate member 67 switches the opening and closing state of the check valve 4 which is provided in an ink flow path 5 of the supply tube 16 by being moved in the container forward and backward direction Y as will be described later.

(Positional Alignment of Ink Container and Mitigating Shocks Using Dampers)

A first guide hole 86 and a second guide hole 87 are formed in the front plate section 80A of the adapter 80. The first guide hole 86 and the second guide hole 87 are arranged symmetrically in the container width direction X with the YZ plane (the YZ plane which includes the line C-C in FIG. 8B), which passes through the center of the tip end of the protruding section 81*a* of the ink leading section 81, as a reference. The first guide hole 86 is arranged on the +X direction side with regard to the protruding section 81*a* and the second guide hole 87 is arranged on the −X direction side with regard to the protruding section 81*a*. The first guide hole 86 and the second guide hole 87 pass through the front plate section 80A in the container forward and backward direction Y. The first guide hole 86 is a long hole which is long and narrow in the container width direction X. On the other hand, the second guide hole 87 is a hole which is a perfect circle. The diameters (the inner diameters) of the first guide hole 86 and the second guide hole 87 are larger than the diameter (the outer diameter of the cylindrical section except for the rib 81*c*) of the protruding section 81*a* in the ink leading section 81.

In addition, a first concave section 88 is formed in the front plate section 80A of the adapter 80 further to the +X direction side with regard to the first guide hole 86 and a second concave section 89 is formed in the front plate section 80A of the adapter 80 further to the −X direction side with regard to the second guide hole 87. The first concave section 88 and the second concave section 89 are concave sections which are recessed in the −Y direction. The first concave section 88 and the second concave section 89 are arranged symmetrically in the container width direction X with the line C-C as a reference and are arranged equal distances from the protruding section 81*a* of the ink leading section 81. The first concave section 88, the first guide hole 86, the second guide hole 87, and the second concave section 89 are arranged on the front end surface of the adapter in a straight line which is parallel with the container width direction X. The ink leading section 81 is arranged more to the upper side (the +Z direction side) of the container than the arrangement positions of the first concave section 88, the first guide hole 86, the second guide hole 87, and the second concave section 89. In addition, a straight line D which passes through the center of a bottom surface 88*a* of the first concave section 88 and the center of a bottom surface 89*a* of the second concave section 89 overlaps with first and second fitted sections 84 and 85 (refer to FIGS. 8A and 8B), which are parts for fitting the first and second fitting sections 25 and 26 of the tray 24, in the adapter 80.

On the other hand, two guide pins 56 and 57 (a mounting member side engaging section), which protrude from the mounting member body section 50A in the −Y direction, are provided in the mounting member 50. The guide pin 56 is arranged on the +X direction side with regard to the through hole section 51 and the guide pin 57 is arranged on the −X direction side with regard to the through hole section 51. The diameters of the guide pins 56 and 57 are larger than the protruding section 81*a* of the ink leading section 81 in the same manner of the first guide hole 86 and the second guide hole 87. In addition, dampers 58 and 59 are arranged on the outer side with regard to the guide pins 56 and 57 in the container width direction X. The damper 58 is arranged on the +X direction side with regard to the guide pin 56 and the damper 59 is arranged on the −X direction side with regard to the guide pin 57. Tip end sections of the dampers 58 and 59 protrude from the mounting member body section 50A in the −Y direction. The damper 58, the guide pin 56, the guide pin 57, and the damper 59 are arranged in a straight line which is parallel with the container width direction X.

Figure 10:
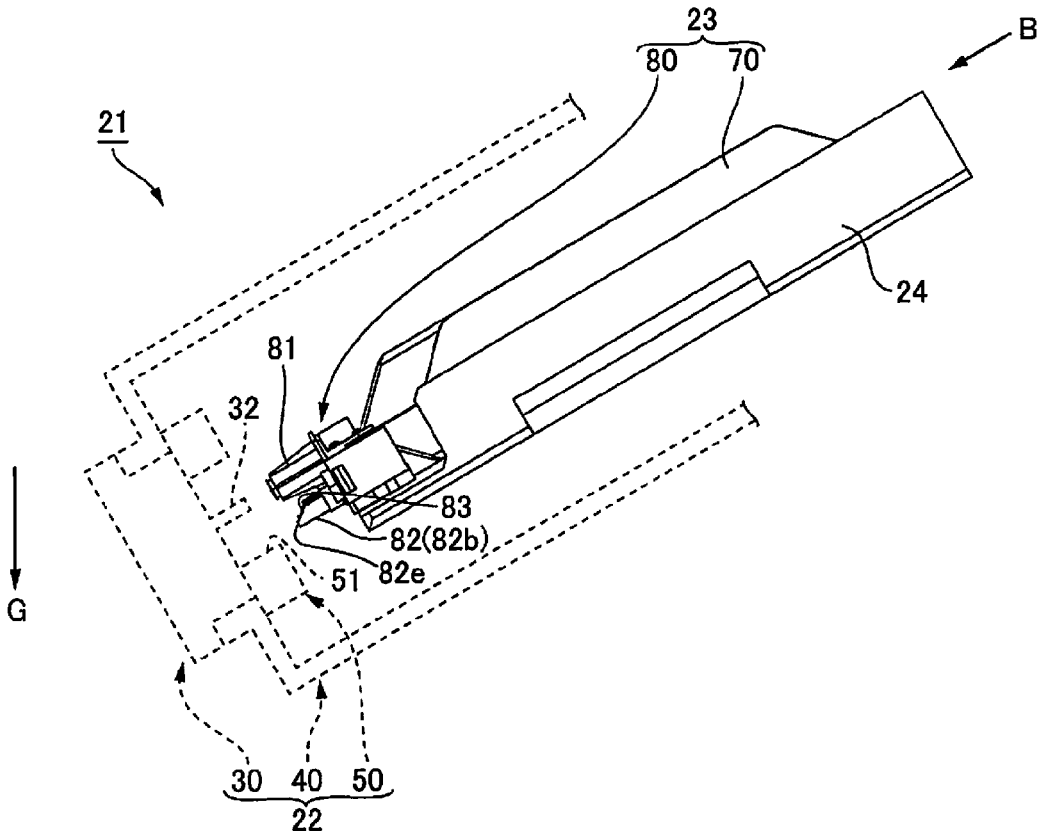
FIG. 10 is a side surface diagram schematically illustrating the posture of an ink container containing section and an ink container.

FIG. 10 is a side surface diagram schematically illustrating the posture of the ink container containing section 22 and the ink container 23. As shown in the diagram, the ink container containing section 22 is arranged with a posture which is inclined so that an end section in the +Y direction where the cover 30 is mounted is on the lower side in the vertical direction G. Since the ink supply section 32 is provided in the cover 30, the ink container containing section 22 is arranged to be inclined so that the ink supply section 32 is on the lower side in the vertical direction G. The ink container 23 and the tray 24 are mounted in the ink container containing section 22 with a posture where the adapter 80 is arranged on the lower side in the vertical direction G and is inclined with an angle which is the same as the ink container containing section 22. That is, the mounting direction B of the ink container 23 in the ink container containing section 22 is diagonally downward.

The ink container 23 is inserted into the ink container containing section 22 with the adapter 80 which is arranged at the front opposing the mounting member 50 in the container forward and backward direction Y. At this time, the guide pin 56 of the mounting member 50 opposes the first guide hole 86 of the adapter 80 and the guide pin 57 of the mounting member 50 opposes the second guide hole 87 of the adapter 80. In addition, the damper 58 of the mounting member 50 opposes the first concave section 88 of the adapter 80 and the damper 59 of the mounting member 50 opposes the second concave section 89 of the adapter 80. When the ink container 23 is moved in the mounting direction B (that is, in the +Y direction), the adapter 80 which is arranged in the front gets closer to the mounting member 50. At this time, first, inserting of the dampers 58 and 59 into the first and second concave sections 88 and 89 is started. Next, inserting of the guide pins 56 and 57 into the first and second guide holes 86 and 87 starts before the tip ends of the dampers 58 and 59 come into contact with the bottom surfaces 88*a* and 89*a* of the first and second concave sections 88 and 89.

The guide pins 56 and 57 are inserted into the first and second guide holes 86 and 87 and engage with the first and section guide holes 86 and 87 while being guided by the taper sections which are formed in the tip ends of the guide pin 56 and 57. Except for the tapered sections, the diameters of the guide pins 56 and 57 are constant circular column shapes. When portions with the circular column shapes in the guide pins 56 and 57 are inserted into the first and second guide holes 86 and 87, the adapter 80 is positionally aligned on the XZ plane with regard to the mounting member 50. At this time, the second guide hole 87 is a reference for positional alignment since the second guide hole 87 is a perfect circle. On the other hand, rotation of the adapter 80 with regard to the mounting member 50 is stopped since the first guide hole 86 is a long hole. After positional alignment on the XZ plane using the guide pins 56 and 57 and the first and second guide holes 86 and 87 is completed, the tip ends of the dampers 58 and 59 abut with the bottom surfaces 88*a* and 89*a* of the first and second concave sections 88 and 89 (refer to FIGS. 8A and 8B).

The dampers 58 and 59 are air dampers which are able to expand and contract in the container forward and backward direction Y. The dampers 58 and 59 are provided with a concave section space (which is omitted from the drawings), which is formed in the protruding sections 58*a* and 59*a* which protrude from the mounting member body section 50A in the −Y direction, and pistons 58*b* and 59*b* which seal one end of the concave space. The concave section space extends in the container forward and backward direction Y, and the pistons 58*b* and 59*b* are able to move in the +Y direction, in which air in the concave section space is compressed, and the opposite direction to the +Y direction. A coil spring (which is omitted from the drawings) is arranged between the bottom section of the concave section space and the pistons 58*b* and 59*b*.

After the tip end surfaces of the pistons 58*b* and 59*b* abut with the bottom surfaces 88*a* and 89*a* of the first and second concave sections 88 and 89, the dampers 58 and 59 press and move the pistons 58*b* and 59*b* in the +Y direction in accompaniment with the ink container 23 moving further in the mounting direction B (that is, in the +Y direction). At this time, since the pistons 58*b* and 59*b* compress air in the concave section space, a buffering force, which resists the force of inertia of the ink container 23 which moves in the mounting direction B, is generated in the dampers 58 and 59. Accordingly, after the dampers 58 and 59 abut with the bottom surfaces 88*a* and 89*a* of the first and second concave sections 88 and 89, the force of shocks, which act on the protruding parts of the ink container containing section 22 and the ink container 23, is reduced using the buffering action of the dampers 58 and 59.

As described above, the ink container 23 is provided with the ink leading section 81 which protrudes from the adapter 80 in the +Y direction. On the other hand, the ink supply section 32, which protrudes from the through hole section 51 of the mounting member 50 to the ink container 23 side, is provided in the ink container containing section 22. When positional alignment of the adapter 80 on the XZ plane is carried out with regard to the mounting member 50 by the guide pins 56 and 57 engaging with the first and second guide holes 86 and 87, the ink leading section 81 of the ink container 23 opposes the ink supply section 32 of the ink container containing section 22. After a state is reached where the guide pins 56 and 57 engaging with the first and second guide holes 86 and 87 and buffering action acts due to the dampers 58 and 59 starting to compress, the ink leading section 81 is connected with the ink supply section 32. A sealing member (which is omitted from the drawings), which is pushed in the +Y direction by a spring seat, is provided at the tip end section of the ink leading section 81. When the ink leading section 81 is not connected with the ink supply section 32, the sealing member stops ink from flowing out by blocking off the ink leading section 81. When the ink leading section 81 is connected with the ink supply section 32, the sealing member is pressured and moved in the −Y direction by the ink supply needle, and as a result, the flow path inside the ink leading section 81 and the flow path inside the ink supply section 32 are linked.

After the ink supply section 32 and the ink leading section 81 are connected, the ink container 23 moves further in the mounting direction B (the +Y direction). At this stage, connecting of the connection terminal 62, which is held in the cover 30 of the ink container containing section 22, and the circuit board 83, which is held in the adapter 80 of the ink container 23, is performed. That is, when the ink supply section 32 and the ink leading section 81 are connected, the board holding section 82 which holds the circuit board 83 is already inserted into the tip end side of the through hole section 39*a* where the connector unit 60 is attached.

Grooves 82*d* (refer to FIGS. 8A and 8B and FIGS. 9A to 9C) which extend in the container forward and backward direction Y are formed in the board holding section 82 at two locations on the outer circumference surface of the base end section 82*a*. On the other hand, engaging sections 64 (refer to FIGS. 9A to 9C) which protrude in the −Y direction are provided in the connector unit 60 which is mounted in the through hole section 39*a* on either side of the connection terminal 62 in the X direction. The engaging sections 64 are arranged inside the through hole section 39*a* at two locations which oppose the grooves 82*d* in the board holding section 82 in the container forward and backward direction Y. The engaging sections 64 engage with the groove sections 82*d* when the board holding section 82 is inserted in the through hole section 39*a*. Due to this, positional alignment of the board holding section 82 (positional alignment on the XZ plane) is carried out inside the through hole 39*a* with regard to the connection terminal 62 which is provided in the connector unit 60.

When the ink container 23 moves further in the mounting direction B from this state, first, the O-ring (which is omitted from the drawings), which is mounted in the base end section 82*a* of the board holding section 82, is flattened by the tip end surface of the terminal arrangement section 39. Due to this, the through hole section 39*a* is no longer linked with the pressurized space inside the ink container containing section 22 and it is possible to perform connecting of the circuit board 83 and the connection terminal 62 outside of the pressurized space. Next, the connection terminal 62, which is attached to the inclined surface 61 of the connector unit 60, and the circuit board 83, which is attached to the inclined surface 82*c* of the board attachment section 82*b*, come into contact inside the through hole section 39*a*. During contact, the circuit board 83 and the connection terminal 62 are in sliding contact along the inclination direction of the inclined surfaces 61 and 82*c*.

As above, the ink container 23 is mounted in the ink container containing section 22 through the five steps of (1) to (5) below.

(1) Positionally aligning the tray 24 and the ink container 23 using the fitting sections at two locations (2) Positionally aligning of the mounting member 50 and the ink container 23 using the two guide pins 56 and 57

(3) Generating buffering action using the dampers 58 and 59

(4) Connecting the ink supply section 32 and the ink leading section 81

(5) Contacting of the connection terminal 62 on the ink container containing section 22 side and the circuit board 83 on the ink container 23 side (Structure for Preventing Extraction of Ink Container)

When the ink container 23 is mounted in the ink container containing section 22, the end plate section 80B of the adapter 80 is positioned on the inner side of the end plate section 50B of the mounting member 50 in the container width direction X, and the end plate section 80C is positioned on the inner side of the end plate section 50C of the mounting member 50 in the container width direction X. Plate springs 90 are attached to the inner side surfaces of the end plate sections 50B and 50C in the container width direction X as shown in FIG. 3. On the other hand, locking sections 91, which are protruding sections which protrude from the outer side surfaces in the container width direction X, are formed in the end plate sections 80B and 80C. When the ink container 23 moves in the mounting direction B inside the ink container containing section 22, the plate springs 90 and the locking sections 91 engage at two locations between the end plate section 50B and the end plate section 80B and between the end plate section 50C and the end plate section 80C. When the five steps of (1) to (5) described above are completed, engaging of the plate springs 90 and the locking sections 91 at both end sections of the ink container 23 in the container width direction X is also completed. Engaging is not released due to weak vibration at the locations where the plate springs 90 and the locking sections 91 are engaged. Accordingly, engaging of the plate springs 90 and the locking sections 91 functions to prevent extraction for the ink container 23 when there is vibration. On the other hand, a user easily releases engaging at the engaging locations using a force to the extent of pulling the ink container 23. Accordingly, replacement of the ink container 23 is easy. Here, the locking sections 91 may engage due to an elastic engaging member other than the plate spring 90 being provided in the mounting member 50. In addition, a structure for engaging using the plate spring 90 and the locking 91 may be provided only at one end of the adapter 80 in the container width direction X.

(Opening and Closing Operation of Check Valve Working Together with Attaching and Detaching Operation of Ink Container)

Connecting of the connection terminal 62 of the connector unit 60 which is mounted to the cover 30 and the circuit board 83 which is provided in the ink container 23 is performed in the final stage as described above when the ink container 23 is mounted in the ink container containing section 22, and at this time, the intermediate member 67 of the connector unit 60 is pressured and moved in the mounting direction B (in the +Y direction) by the abutting surface 82*e* of the board holding section 82 at the same time. As a result, the protruding dimensions of the first protruding section 67*a* from the through hole 65*c* is increased. In addition, when the ink container 23 is removed from the ink container containing section 22, there is a state where movement of the intermediate member 67 is not regulated by the abutting surface 82*e* and it is possible for the intermediate member 67 to return in the −Y direction. As described below, when the protruding dimensions of the first protruding section 67*a* to the front surface side (the +Y direction side) of the cover 30 changes due to the intermediate member 67 moving in the container forward and backward direction Y, there is a switch in the opening and closing state of the check valve 4 which is provided in the ink flow path 5 inside the supply tube 16.

Figure 11A:
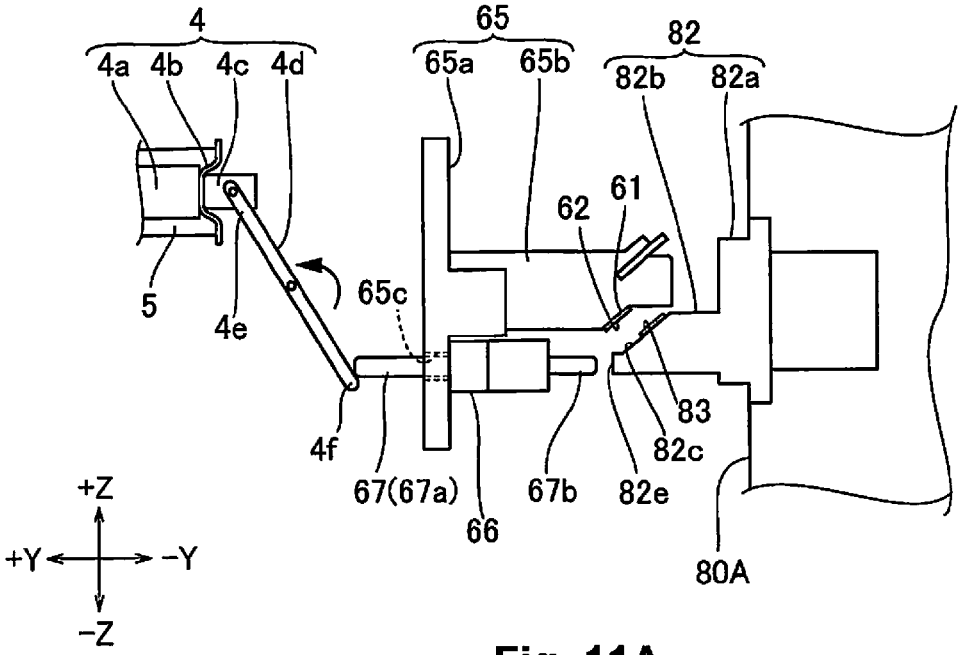
FIGS. 11A and 11B are explanatory diagrams illustrating switching of the opening and closing state of a check valve using an intermediate member.
Figure 11B:
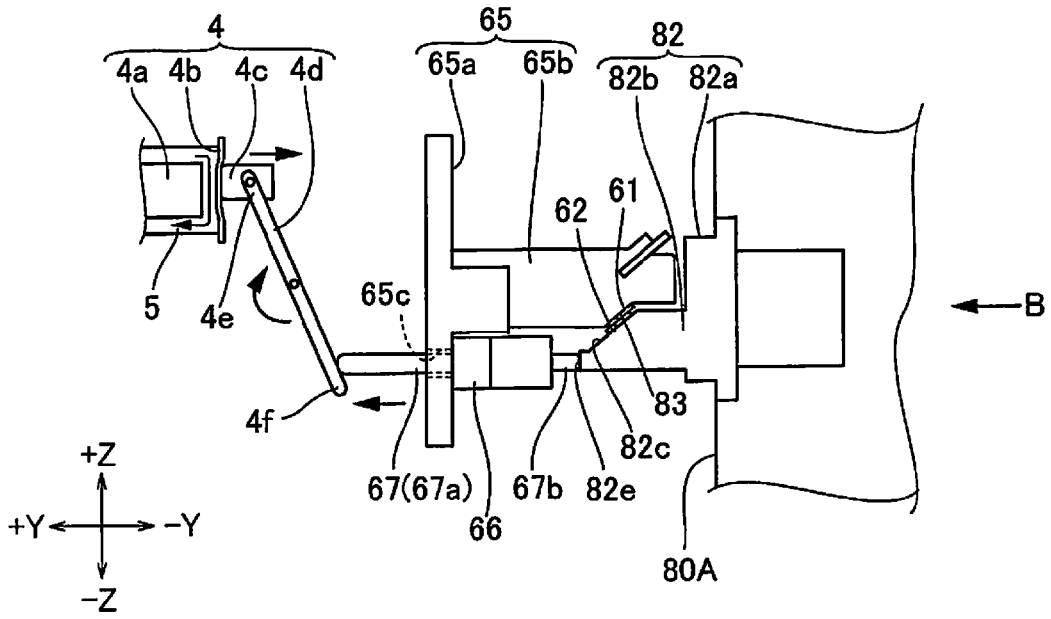

FIGS. 11A and 11B are explanatory diagrams illustrating switching of the opening and closing state of the check valve 4 using the intermediate member 67, FIG. 11A illustrates the position of the intermediate member 67 when the check valve 4 is in a closed state, and FIG. 11B illustrates the position of the intermediate member 67 when the check valve 4 is in a opened state. The check valve 4 is a diaphragm valve and is provided with a valve seat 4*a*, a diaphragm 4*b*, a driving section 4*c*, and a driving lever 4*d*. The valve seat 4*a* is provided in the ink flow path 5 of the supply tube 16 and the diaphragm 4*b* is arranged so as to oppose the valve seat 4*a*. The driving section 4*c* is formed on the rear surface side of the diaphragm 4*b*. One end 4*e* of the driving lever 4*d* engages with the driving section 4*c* and an other end 4*f* of the driving lever 4*d* opposes the first protruding section 67*a* of the intermediate member 67 in the container forward and backward direction Y. The driving lever 4*d* is supported as so to be able to swing with the rotation axis which extends in the X axis direction as the center. As shown in FIG. 11A, the driving lever 4*d* is pushed in a swinging direction where the one end 4*e* moves to the valve seat 4*a* side (in the +Y direction) by a pushing member which is not shown in the drawings. That is, the driving lever 4*d* is pushed in a direction where the one end 4*e* pushes the diaphragm 4*b* against the valve seat 4*a* via the driving section 4*c*. At this time, the other end 4*f* of the driving lever 4*d* is pushed in the −Y direction and abuts with the first protruding section 67*a* of the intermediate member 67.

The circuit board 83 is separated from the connection terminal 62 and the abutting surface 82*e* of the board holding section 82 which is provided in the ink container 23 is separated from the second protruding section 67*b* of the intermediate member 67 to the −Y direction side as shown in FIG. 11A before completion of mounting of the ink container 23 in the ink container containing section 22. At this time, the driving lever 4*d* has a posture where the diaphragm 4*b* pushes against the valve seat 4*a* via the driving section 4*c* and the intermediate member 67 moves to the −Y direction side due to the other end 4*f* of the driving lever 4*d*. This is the state where the check valve 4 is closed. In this manner, the check valve 4 is in a closed state before completion of mounting of the ink container 23 in the ink container containing section 22.

When the ink container 23 moves in the mounting direction B, the abutting surface 82*e* of the board holding section 82 which is provided in the ink container 23 abuts with the second protruding section 67*b* of the intermediate member 67 and the intermediate member 67 is pressured and moved in the +Y direction. Due to this, the driving lever 4*d* swings with a direction which is the reverse of the pushing direction due to the first protruding section 67*a* moving in the +Y direction. As a result, the one end 4*e* of the driving lever 4*d* moves in the −Y direction and moves the diaphragm 4*b* in the −Y direction via the driving section 4*c*. Due to this, the ink flow path is linked due to the diaphragm 4*b* being separated from the valve seat 4*a* as shown in FIG. 11B. This is the state where the check valve 4 is open. In this manner, the intermediate member 67 functions as the operation section which switches the check valve 4 from the closed state to the open state by working together with the mounting operation of the ink container 23 in the ink container containing section 22.

The check valve 4 is in the opened state while the ink container 23 is mounted in the ink container containing section 22. When the ink container 23 is removed from the ink container containing section 22, the abutting surface 82*e* of the board holding section 82 is no longer at the −Y direction side of the intermediate member 67. For this reason, the intermediate member 67 moves in the −Y direction due to the pushing force of the coil spring which is mounted at an inner section of the through hole which is formed in the holding member 66. As a result, the one end of the driving lever 4*d* moves in the +Y direction and the other end 4*f* of the driving lever 4*d* swings in a direction so as to move in the −Y direction. Then, at this time, the one end 4*e* of the driving lever 4*d* pushes the diaphragm 4*b* against the valve seat 4*a* via the driving section 4*c*. That is, the check valve 4 is switched from the open state to the closed state by working together with the removing operation of the ink container 23 from the ink container containing section 22. The check valve 4 is in the closed state while the ink container 23 is removed from the ink container containing section 22.

(Actions and Effects)

As above, the ink container 23 of the present embodiment is mounted in the ink container containing section 22, which is provided in the ink containing unit 20 of the printer 1, so as to be able to be attached and detached. Ink in the ink container 23 which is mounted in the ink container containing section 22 is supplied from the ink supply section 32 which is provided in the ink container containing section 22 to the ink jet head 11 via the supply tube 16 and the intermediate tank 14, which are provided in the printer body section 10, and the supply tube 15. The check valve 4 which opens and closes the ink flow path 5 inside the supply tube 16 is provided in the connection section of the supply tube 16 and the ink supply section 32. Then, the intermediate member 67, which switches the opening and closing state of the check valve 4 by working together with the attaching and detaching operation of the ink container 23 in the ink container containing section 22, is provided in the cover 30 of the ink container containing section 22. By doing this, when the ink container 23 is removed from the ink container containing section 22, it is possible for the intermediate member 67 to move to work together with this operation and for the check valve 4 to be closed. Accordingly, it is possible to reliably close the check valve 4 even when the ink container 23 is extracted in a state where the power of the printer 1 is turned off. As such, it is possible to prevent leakage of liquid from the ink flow path 5 inside the supply tube 16. In addition, it is possible to prevent connection faults since it is possible to reliably open the check valve 4 when the ink container 23 is mounted.

In addition, the ink container 23 of the present embodiment is provided with the ink pack 70 and the adapter 80 which is provided at the front end of the ink pack 70 in the mounting direction B of the ink container containing section 22. The adapter 80 is mounted in the ink container containing section 22 so as to be able to be attached and detached and the ink pack 70 is positionally aligned in the ink container containing section 22. The intermediate member 67 is able to move in the mounting direction B of the ink container 23 and the intermediate member 67 is pressured and moved in the mounting direction B when the ink container 23 moves in the mounting direction B due to the abutting surface 82*e* of the board holding section 82 which is formed in the adapter 80. The check valve 4 opens and closes by the diaphragm 4*b* moving due to movement of the intermediate member 67 in the container forward and backward direction Y. In this manner, since the intermediate member 67 is a simple configuration which only slides in the container forward and backward direction Y in the present embodiment, and the configuration is simple and it is advantageous in terms of reducing size and saving space.

In addition, in the present embodiment, the driving lever 4*d* moves via the intermediate member 67 due to the intermediate member 67 being arranged between the driving lever 4*d* of the check valve 4 and the abutting surface 82*e* of the board holding section 82 which is formed in the adapter 80 of the ink container 23. In this manner, it is possible to reduce the protruding dimensions of the board holding section 82 which is provided on the ink container 23 side due to the driving lever 4*d* being driven via the intermediate member 67. Accordingly, it is possible to reduce damage to the board holding section 82 in a case where shocks are applied such as when the ink container 23 is dropped or mounted.

In addition, in the present embodiment, the area of the abutting surface 82*e* of the board holding section 82 is larger than the area of the tip end surface of the second protruding section 67*b* of the intermediate member 67. Accordingly, it is possible to maintain a state of abutting between the second protruding section 67*b* and the abutting surface 82*e* even when there is positional deviation between the abutting surface 82*e* and the second protruding section 67*b* due to an environmental change such as a change in temperature or humidity or the margin of error in the dimensions of the components, measurement errors in assembly, or the like. Accordingly, it is possible to reliably open and close the check valve 4.

In addition, in the present embodiment, the abutting surface 82*e* which pressures and moves the intermediate member 67 is formed in the board holding section 82, where the circuit board 83 is attached, more to the tip end side than the circuit board 83. Accordingly, it is possible to prevent damage to the circuit board 83 due to a part which protrudes even further than the circuit board 83 such as when the ink container 23 is mounted or dropped. In addition, it is advantageous in terms of saving space and simplifying the configuration since it is not necessary to separately secure a part for attaching the circuit board 83. In addition, the abutting surface 82*e* is formed so as to be positioned below the circuit board 83 in the vertical direction G when the ink container 23 is mounted in the ink container containing section 22. For this reason, it is difficult for foreign matter, which is generated due to contact between the second protruding section 67*b* of the intermediate member 67 and the abutting surface 82*e* of the board holding section 82, to fall onto the circuit board 83. Accordingly, it is possible to prevent contact faults between the circuit board 83 and the connection terminal 62 due to foreign matter.

Here, in the present embodiment described above, the position and shape of the intermediate member 67 may be different to the embodiment described above. That is, it is sufficient if it is possible for the intermediate member 67 to open and close the check valve 4 by moving in the mounting direction B or a different direction due to the ink container 23 which moves in the mounting direction B.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least E 5% of the modified term if this deviation would not negate the meaning of the word it modifies.

While only a selected embodiment has been chosen to illustrate the present invention, it will be apparent to those skilled in the art from this disclosure that various changes and modifications can be made herein without departing from the scope of the invention as defined in the appended claims. Furthermore, the foregoing descriptions of the embodiment according to the present invention are provided for illustration only, and not for the purpose of limiting the invention as defined by the appended claims and their equivalents.

What is claimed is:

1. A liquid container configured to be detachably attached to a liquid container containing section in a liquid ejecting apparatus that includes the liquid container containing section, a supply flow path that supplies liquid from a liquid supply section that is provided in the liquid container containing section to a liquid ejecting section, and an opening and closing section that opens and closes the supply flow path, the liquid container comprising:

an operation section configured to switch an opening and closing state of the opening and closing section by working together with an attaching and detaching operation with regard to the liquid container containing section; and a circuit board provided in the operation section and configured to connect with a connection terminal in the liquid ejecting apparatus, the operation section including a protrusion, the operation section further including an abutting section that abuts with one end of an intermediate member that is arranged between the opening and closing section and the operation section, the abutting section being arranged more to a tip end side than the circuit board in a mounting direction of the liquid container with regard to the liquid container containing section.

2. The liquid container according to claim 1, wherein the operation section is movable in the mounting direction of the liquid container with regard to the liquid container containing section.

3. The liquid container according to claim 1, wherein an area of the abutting section is larger than an area of the one end of the intermediate member.

4. The liquid container according to claim 1, wherein the abutting section is provided below the circuit board in a vertical direction.

5. The liquid container according to claim 1, wherein the abutting section is formed to be perpendicular with regard to the mounting direction of the liquid container.

6. The liquid container according to claim 1, wherein the operation section has a protruded shape, and the operation section includes an inclining potion and a protruding portion, the inclining potion has an inclining surface that is inclined to the mounting direction and a perpendicular direction perpendicular to the mounting direction, and the protruding section is protruded in the mounting direction from the inclining portion and has a abutting surface that is farthest away from the inclining portion and is configured to abut with one end of an intermediate member that is arranged between the opening and closing section and the operation section.

7. The liquid container according to claim 1, further comprising a liquid pack containing the liquid, wherein the operation section is fixedly attached to the liquid pack.

8. An adapter configured to be detachably attached to a liquid container containing section in a liquid ejecting apparatus that includes the liquid container containing section, a supply flow path that supplies liquid from a liquid supply section in the liquid container containing section to a liquid ejecting section, and an opening and closing section that opens and closes the supply flow path, and configured to be attached to a liquid containing body that is contained in the liquid container containing section, the adapter comprising:

an operation section configured to switch an opening and closing state of the opening and closing section by working together with an attaching and detaching operation with regard to the liquid container containing section; and a circuit board provided in the operation section and configured to connect with a connection terminal in the liquid ejecting apparatus, the operation section including a protrusion, the operation section further including an abutting section that abuts with one end of an intermediate member that is arranged between the opening and closing section and the operation section, the abutting section being arranged more to a tip end side than the circuit board in a mounting direction of the adapter with regard to the liquid container containing section.

9. The adapter according to claim 8, wherein the operation section is movable in the mounting direction of the adapter with regard to the liquid container containing section.

10. The adapter according to claim 8, wherein an area of the abutting section is larger than an area of the one end of the intermediate member.

11. The adapter according to claim 8, wherein the abutting section is provided below the circuit board in a vertical direction.

12. The adapter according to claim 8, wherein the abutting section is formed to be perpendicular with regard to the mounting direction of the adapter.

13. A liquid ejecting apparatus comprising:

a liquid container containing section;

a supply flow path that supplies liquid from a liquid supply section that is provided in the liquid container containing section to a liquid ejecting section;

an opening and closing section that opens and closes the supply flow path; and a liquid container configured to be contained in the liquid container containing section, the liquid container including an operation section configured to switch an opening and closing state of the opening and closing section, by working together with an attaching and detaching operation of the liquid container with regard to the liquid container containing section, and a circuit board provided in the operation section and configured to connect with a connection terminal in the liquid ejecting apparatus, the operation section including a protrusion, the operation section further including an abutting section that abuts with one end of an intermediate member that is arranged between the opening and closing section and the operation section, the abutting section being arranged more to a tip end side than the circuit board in a mounting direction of the liquid container with regard to the liquid container containing section.

14. The liquid ejecting apparatus according to claim 13, wherein the opening and closing state of the opening and closing section is switched by the operation section that moves in the mounting direction of the liquid container with regard to the liquid container containing section.

15. The liquid ejecting apparatus according to claim 13, wherein the opening and closing section is abuttable with the other end of the intermediate member.

* * * * *